US009401546B2

(12) United States Patent
Butler et al.

(10) Patent No.: US 9,401,546 B2
(45) Date of Patent: Jul. 26, 2016

(54) MMW LOW SIDELOBE CONSTANT BEAMWIDTH SCANNING ANTENNA SYSTEM

(75) Inventors: Jeffrey Butler, Candor, NY (US); Tommy Lam, Apalachin, NY (US); Scott Martin, Ithaca, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 892 days.

(21) Appl. No.: 13/237,479

(22) Filed: Sep. 20, 2011

(65) Prior Publication Data

US 2013/0069832 A1 Mar. 21, 2013

(51) Int. Cl.

| | |
|---|---|
| ***H01Q 19/13*** | (2006.01) |
| ***H01Q 1/28*** | (2006.01) |
| ***H01Q 1/42*** | (2006.01) |
| ***H01Q 13/02*** | (2006.01) |

(52) U.S. Cl.
CPC ..... *H01Q 19/132* (2013.01); *H01Q 1/42* (2013.01); *H01Q 13/0208* (2013.01); *H01Q 1/28* (2013.01)

(58) Field of Classification Search
CPC ..... H01Q 1/28; H01Q 19/32; H01Q 13/0208; H01Q 1/42; H01Q 1/421
USPC ..... 343/872, 705, 757, 775, 761, 852
See application file for complete search history.

(56) References Cited

U.S. PATENT DOCUMENTS

| | | | | |
|---|---|---|---|---|
| 3,936,837 | A * | 2/1976 | Coleman et al. | 343/781 R |
| 4,380,014 | A | 4/1983 | Howard | |
| 4,585,317 | A | 4/1986 | Hodges et al. | |
| 4,920,350 | A * | 4/1990 | McGuire et al. | 343/709 |
| 6,340,956 | B1 * | 1/2002 | Bowen et al. | 343/915 |
| 6,396,453 | B2 * | 5/2002 | Amyotte et al. | 343/786 |
| 2006/0071872 | A1 * | 4/2006 | Gierow et al. | 343/872 |
| 2007/0090957 | A1 | 4/2007 | Kozlovski | |
| 2010/0309089 | A1 | 12/2010 | Collinson et al. | |
| 2011/0205136 | A1 * | 8/2011 | Runyon et al. | 343/786 |

OTHER PUBLICATIONS

Krunal Patel. Designing Optimized Cassegrain with Balanced Feed. IJCA Proceedings on International Conference and workshop on Emerging Trends in Technology (ICWET) (11), Mumbai, Maharashtra, India:26-34, Feb. 25-26, 2011.*

IEEE Standard Definitions of Terms for Antennas, IEEE Std 145-1993 , vol., No., pp. 1-32, Mar. 18, 1993.*

* cited by examiner

*Primary Examiner* — Sue A Purvis
*Assistant Examiner* — Amal Patel
(74) *Attorney, Agent, or Firm* — Wolf, Greenfield & Sacks, P.C.

(57) ABSTRACT

Reflector antennae and related structures and methods are described. The reflector antennae may have a deep f/D ratio and use an offset corrugated horn. Pivoting feed arms may be included for connecting a feed horn to a dish of the antenna. Radomes are also described, which may be formed of two or more pieces.

12 Claims, 7 Drawing Sheets

MMW LOW SIDELOBE CONSTANT BEAMWIDTH SCANNING ANTENNA SYSTEM

BACKGROUND

1. Field

The present application relates to reflector antennae and related structures and methods.

2. Related Art

Helicopters and other aircraft often fly in conditions in which they can come into contact with various objects, such as cables. Contacting such objects can be undesirable, resulting in crashes and/or damage to the aircraft and persons within the aircraft. Therefore, it is desirable to be able to detect such objects, so that collisions and the associated damage may be avoided.

BRIEF SUMMARY

According to one aspect, a reflector antenna is provided. The reflector antenna may comprise a feed comprising a corrugated horn, and a reflector dish configured to reflect a feed signal output by the feed. The reflector antenna may have a f/D ratio of less than approximately 0.3.

According to another aspect, a reflector antenna is provided, comprising a corrugated horn, and a reflector dish. The reflector antenna may be configured to exhibit a substantially constant beamwidth over a frequency range from approximately 30 GHz to approximately 38 GHz.

According to another aspect, a method of operating a reflector antenna is provided. The method comprises shifting a phase center of a feed signal farther from a reflector dish of the reflector antenna while increasing a frequency of operation of the reflector antenna.

According to another aspect, a multi-piece radome is provided. The radome comprises a first piece and a second piece. The first and second pieces are substantially transparent to electromagnetic radiation in a desired wavelength band. The first and second pieces are configured to couple to each other to form a substantially enclosed volume sufficient to accommodate an antenna.

Further aspects of the present application are described below.

BRIEF DESCRIPTION OF DRAWINGS

Various aspects and embodiments of the technology will be described with reference to the following figures. It should be appreciated that the figures are not necessarily drawn to scale. Items appearing in multiple ones of the figures are indicated by the same or similar reference number in all the figures in which they appear.

DETAILED DESCRIPTION

Applicants have appreciated that it may be desirable to provide antennae suitable for being mounted on aircraft and suitable for detecting small objects, such as cables. Thus, according to one aspect of the present application, a reflector antenna suitable for detecting objects as small as ⅜ of an inch, or smaller, is provided, that is also sufficiently small to be suitable for mounting on aircraft. According to a non-limiting embodiment, the antenna may be configured to operate at the millimeter wavelength (mmW) range, such as, for example, between approximately 30 GHz and approximately 38 GHz. According to a non-limiting embodiment, the antenna may include an offset corrugated feed horn and a reflector dish, coupled together by one or more feed arms.

Applicants have appreciated that detection of certain objects with an antenna may be facilitated by operation of the antenna at mmW frequencies. Cables, as a non-limiting example, may be relatively small, ranging in diameter from ¼ to ½ of an inch (e.g., ⅜ of an inch), as non-limiting examples. Applicants have appreciated that detection of objects of such sizes may be accomplished using frequencies between approximately 30 GHz and approximately 38 GHz (e.g., 34 GHz), as non-limiting examples. At such frequencies, detection of the objects may not be significantly adversely impacted by weather conditions (e.g., fog), and yet the signals at such frequencies may still generate a sufficiently strong reflected signal from the object being detected to allow for accurate detection.

Thus, according to an aspect of the present application, an antenna is configured for operation at frequencies between approximately 30 GHz and approximately 38 GHz (e.g., 34 GHz). The antenna may be configured to be of a small size suitable for mounting on an aircraft (e.g., helicopter), while also operating at low power and maintaining a substantially constant beamwidth. The antenna may be configured to detect objects as small as ⅜ of an inch from a distance of up to 3 km or more.

According to another aspect, a multi-piece radome is provided. The multi-piece radome may be formed of two or more pieces (which may be referred to as sub-radomes) which may be couplable to enclose an antenna and removable to provide access to the antenna. In a non-limiting embodiment, a two-piece radome is provided that includes two substantially hemispherical pieces which may mate to each other to form an enclosed volume sufficient to accommodate antennae of the type described herein. One or both of the pieces may be formed of a material substantially transparent to electromagnetic waves in a frequency range corresponding to a desired operating frequency range of an antenna to be enclosed within the radome.

The aspects described above, as well as additional aspects, are described further below. These aspects may be used individually, all together, or in any combination of two or more, as the technology is not limited in this respect.

Figure 1:
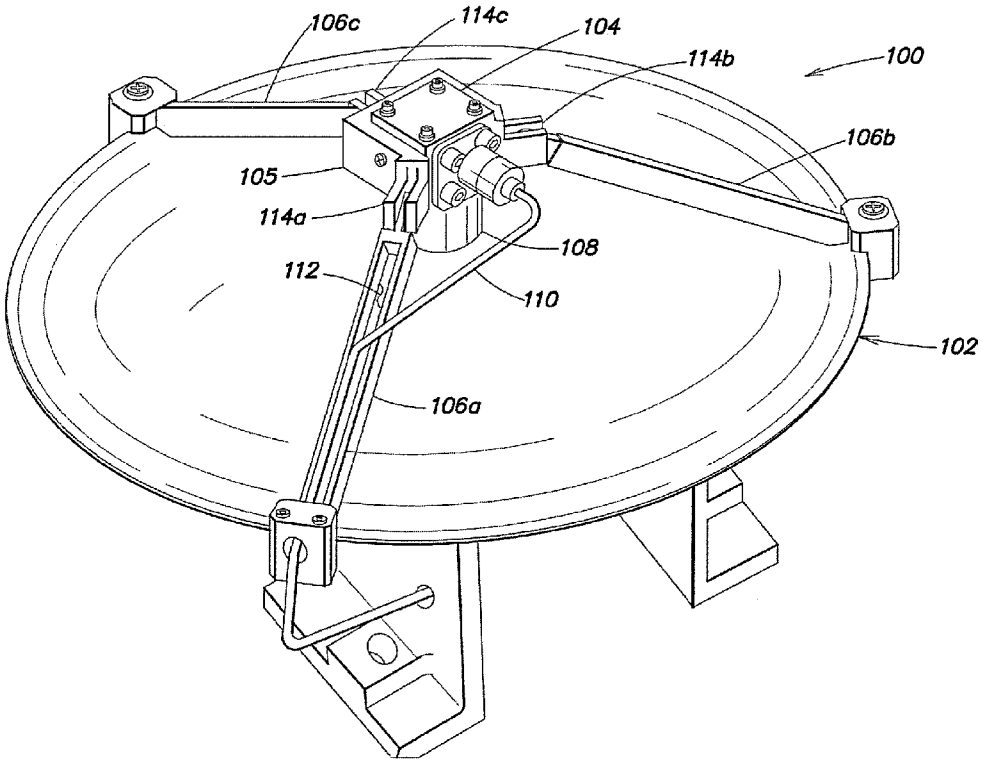
FIG. 1 illustrates a reflector antenna according to one non-limiting embodiment.

FIG. 1 illustrates a non-limiting example of a reflector antenna according to a first aspect of the present application, which in some embodiments may be a scanning antenna. As shown, the antenna 100 includes a parabolic reflector dish 102, a feed unit (or feed subassembly) 104 mounted to a bracket 105, and three feed arms 106*a*-106*c*. The feed unit 104 includes a feed horn (or simply a "horn") 108. A feed cable 110 connects the feed unit 104 to external processing circuitry (not shown), and is configured to transmit signals between the feed unit 104 and the external processing circuitry (e.g., to the feed unit 104 from the external processing circuitry and/or from the feed unit 104 to the external processing circuitry). The feed cable 110 may be any suitable cable for performing such functionality, such as a radio frequency (RF) coaxial cable or any other suitable cable. It should be appreciated that FIG. 1 is a non-limiting representation of an antennae according to one embodiment, and that alternatives are possible.

Figure 2:
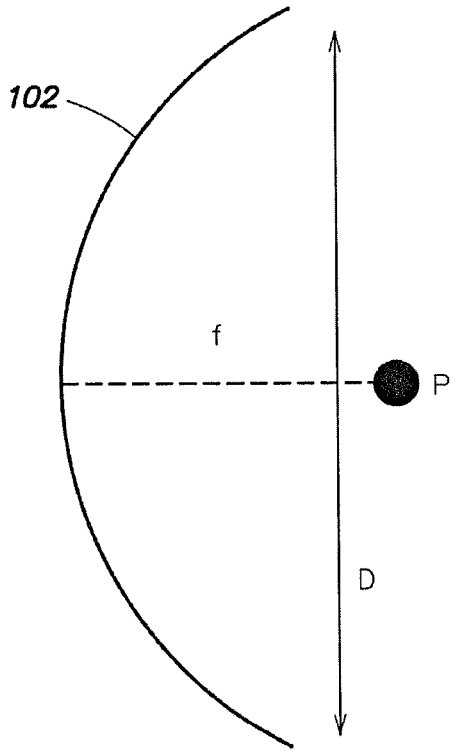
FIG. 2 illustrates a parabolic reflector dish suitable for use in the antenna of FIG. 1, according to a non-limiting embodiment.

According to one aspect of the present application, a reflector antenna, such as antenna 100 of FIG. 1, may have a low (or "deep") f/D ratio. In some such embodiments, the low f/D ratio may be combined with an excessive aperture size of the antenna. The f/D ratio of a reflector antenna is the ratio of the focal length f of the antenna to the diameter D of the antenna aperture. A non-limiting example is shown with respect to FIG. 2, which illustrates a side view of the reflector dish 102 of FIG. 1 having a focal point P. The focal length f and diameter D are illustrated.

Using a low f/D ratio, in some embodiments in combination with an excessive aperture size, may facilitate maintaining a constant (or substantially constant) beamwidth over a wide range of operating frequencies, and may also facilitate low sidelobe generation. Antennas with constant beamwidth over operating frequency may be desirable in some embodiments to: 1) overcome signal distortion due to wideband waveforms for cable detection; and 2) provide stable detection processing for a given fix scan rate. If beamwidth becomes narrower at the highest frequency, as is typical for most antennas, an image frame of the cable detection may not be processed sufficiently, because the instantaneous coverage area for a given scan rate may become insufficient.

Applicants have appreciated that, because a low f/D ratio may provide high amplitude tapering, such a ratio may also facilitate maintaining a constant (or substantially constant) beamwidth over a particular bandwidth and may minimize feed blockage. Typically, as the frequency of operation of a reflector antenna increases, its beamwidth narrows. Such narrowing may be undesirable in certain circumstances, for instance because narrowing of the beam may impair the ability of the antenna to detect certain objects of interest, such as cables. Use of a low (deep) f/D ratio increases the amplitude tapering of the antenna. Amplitude tapering refers to the difference in magnitude between the antenna beam at the center of the reflector dish and the edge of the reflector dish. By increasing the amplitude tapering, the constancy of the beamwidth may be improved for changes in operating frequency.

Figure 4:
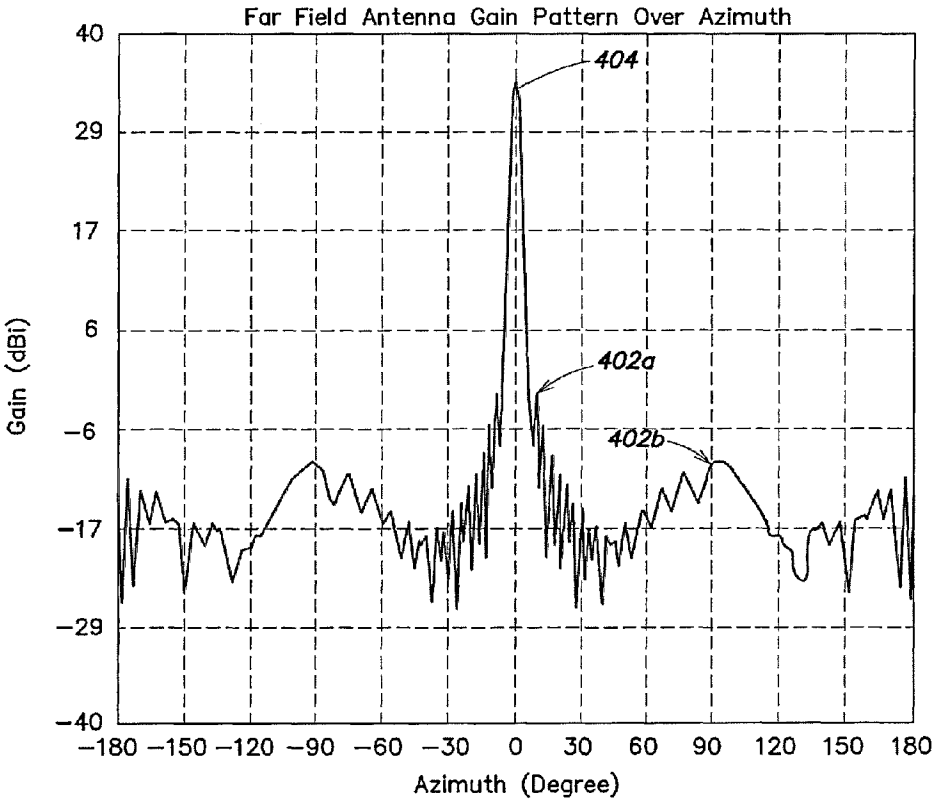
FIG. 4 illustrates a gain pattern of the antenna of FIG. 1, according to a non-limiting embodiment.

Moreover, using a low f/D ratio may also result in relatively low sidelobes of the antenna, described further below in connection with FIG. 4.

In addition to using a low f/D ratio, according to one aspect of the present application an excessive aperture size is used. The aperture size may be controlled by controlling the size (e.g., diameter) of the reflector dish. As amplitude taper increases, aperture inefficiency also increases. Thus, to maintain suitable aperture efficiency when using a low f/D ratio according to the embodiments described herein, an aperture size larger than typical may be used. As a non-limiting example, when operating the antenna at 34 GHz with an f/d ratio of approximately 0.2, the reflector dish may have a diameter of approximately six inches, which may be larger than would typically be used for an antenna operating at such frequencies. Thus, the combination of the low f/D ratio and the suitably chosen excessive aperture size may result in substantially constant beamwidth over a wide bandwidth (e.g., over a range from 30-38 GHz).

The f/D ratio may take any suitable value to provide a desired level of constancy of the beamwidth and desired degree of minimization of sidelobes. According to one non-limiting embodiment, the ratio f/D may be between approximately 0.1 and approximately 0.4, between approximately 0.1 and approximately 0.3, between approximately 0.1 and approximately 0.25 (e.g., approximately 0.2), between approximately 0.1 and approximately 0.2, or any other suitable value. As a non-limiting example, a f/D ratio of approximately 0.2 may provide a substantially constant beamwidth over a five degree azimuth and five degree elevation, though other sizes for the beam are also possible. Thus, various values for the f/D ratio of the antenna 100 may be used according to one or more aspects of the present application.

In those embodiments in which excessive aperture size is employed, the aperture size may take any suitable value, as the various embodiments described herein are not limited to use with any particular aperture sizes. For example, in some embodiments the aperture size may be between approximately five and seven inches (e.g., six inches) in diameter, for example when operating the antenna between 30-38 GHz (e.g., at approximately 34 GHz). In some embodiments, the aperture size may be up to 10% larger than would typically be used for a given frequency of operation, up to 20% larger (e.g., between 10-20%), up to 30% larger (e.g., between 15-25%), or any other suitable value.

According to an aspect of the present application, an antenna may include an offset corrugated feed horn. The corrugated feed horn may be "offset" in that the corrugation of the horn may be offset from the face of the horn. In this manner, the phase center of the signal from the feed horn may be variable; it may move away from the reflector dish as frequency increases, in contrast to conventional corrugated feed horns for which the phase center remains at the physical center of the horn aperture for all frequencies. In this manner, the beam from the reflector dish may be "de-focused" or broadened as frequency increases, which may counteract the typical narrowing of the beam when frequency increases.

Figure 3A:
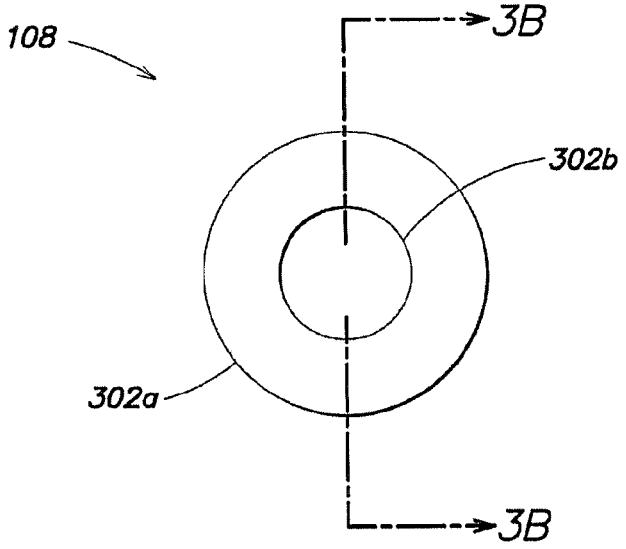
FIGS. 3A and 3B illustrate a top-view and cross sectional view, respectively, of an offset corrugated horn which may be used with the reflector antenna of FIG. 1, according to a non-limiting embodiment.
Figure 3B:
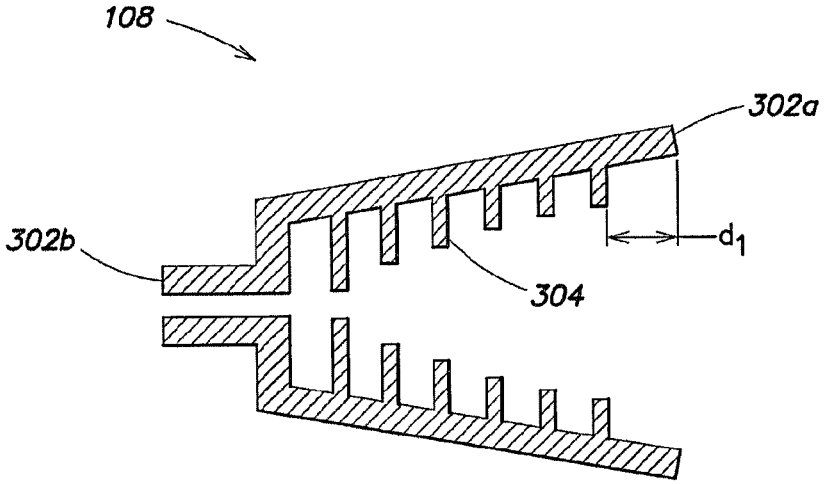

FIGS. 3A and 3B illustrate a non-limiting example of a suitable offset corrugated feed horn which may be used as the feed horn 108. However, it should be appreciated that the antenna 100 of FIG. 1 is not limited to using such a feed horn. FIG. 3A illustrates a top view of the feed horn 108 of FIG. 1, having ends 302*a* and 302*b*. FIG. 3B illustrates a cross-section, showing the corrugations which the feed horn may include, according to a non-limiting embodiment.

As shown in FIG. 3A, the feed horn 108 may be substantially cylindrical (or conical), with one end 302*a* larger than the other end 302*b*. However, the shapes and sizes illustrated are non-limiting, as alternatives are possible.

As shown in FIG. 3B, corrugations 304 (of any number) may be formed on the inside of the feed horn 108, having any suitable size and spacing. Thus, corrugated feed horns according to one or more of the aspects of the present application are not limited to the number, size, or spacing of corrugations. As also shown, the corrugations 304 may be offset from the front end 302*a* by a distance $d_1$. Assuming that the front end 302*a* of the feed horn 108 is closest to the reflector dish of the antenna, with the back end 302*b* being furthest from the reflector dish, the offset $d_1$ may result in the phase of any signal from the feed horn having a variable location depending on frequency of the signal. For instance, the phase center of the signal may move away from the reflector dish (away from end 302*a* toward end 302*b*) as the signal frequency increases. Such a shift may effectively de-focus the beam from the reflector dish, thus broadening the beam as frequency increases.

The above-described phase shift of the signal from the feed horn away from the reflector dish may be used to maintain a substantially constant beamwidth for the antenna of FIG. 1. As mentioned previously, the beamwidth from the reflector dish typically narrows as the frequency of operation increases. However, the above-described phase shift resulting from the offset corrugated horn may compensate to some degree for the narrowing by causing a broadening de-focusing effect. That, in addition to selection of a suitable f/D ratio, as previously described, may result, for at least some embodiments, in a substantially constant beamwidth from the antenna over a desired bandwidth (e.g., a substantially constant beamwidth over a five degree azimuth and five degree elevation from approximately 30 GHz to approximately 38 GHz).

It should be appreciated from the foregoing that, according to one aspect, a method of operating an antenna having a feed horn and a reflector dish comprises shifting a phase center of a signal provided by the feed horn away from the reflector dish while increasing the frequency of operation of the antenna. In this manner, as explained above, the beamwidth of the antenna may be maintained substantially constant over a given bandwidth of operation of the antenna.

According to another aspect of the present application, an antenna having a feed arm configured to support a feed cable is provided. Typically, to minimize feed blockage, feed arms connecting a feed horn to a reflector dish of an antenna are made as small as possible. By doing so, the feed arm and the feed cable (e.g., feed cable 110 in FIG. 1, which may be a radiofrequency (RF) cable, such as a RF coaxial cable, or any other suitable cable) become of comparable size, such that the feed cable cannot be stably mounted to the feed arm. Thus, the feed cable typically hangs loosely and vibrates when the antenna is in operation. Not only does the feed cable contribute to feed blockage, but the vibration further degrades performance of the antenna by causing amplitude and phase instabilities in the antenna signal. However, as mentioned above, use of a low f/D ratio increases amplitude taper and therefore reduces feed blockage. As a result, the feed arms of the antenna may be made sufficiently large to have a groove therein for accommodating the feed cable. FIG. 1 illustrates a non-limiting example.

As shown, the feed arm 106*a* includes a groove 112 therein. The feed cable 110 may be placed in the groove, as shown. By so doing, the feed cable may be stabilized, thus minimizing or eliminating entirely any vibration of the feed cable. Furthermore, because the feed cable may be placed within a groove of the feed arm, the feed cable may not contribute any more to feed blockage than does the feed arm itself. Thus, positioning of the feed cable as shown may also facilitate low sidelobe performance of the antenna.

While FIG. 1 illustrates a non-limiting example in which the feed cable is disposed in a groove of the feed arm, it should be appreciated that other manners of securing the feed cable to the feed arm to reduce its vibration may be used. For example, clips may be placed on the feed arm, rather than or in addition to a groove. Other manners are also possible.

According to an aspect of the present application, a reflector type antenna is provided which has low (or small) sidelobes. As mentioned previously, use of a low f/D ratio may facilitate generation of low sidelobes, which in turn may facilitate detection of objects. For example, by reducing the sidelobes of the antenna, received signals are more likely to have been received within the central antenna beam. FIG. 4 illustrates a non-limiting example of low sidelobe behavior that may be achieved using one or more of the aspects described herein, such as may be achieved using the antenna 100 of FIG. 1. The x-axis illustrates the azimuth in units of degrees and the y-axis illustrates gain in dBi. The illustrated pattern is a far field antenna gain pattern. As shown, the sidelobes 402*a* and 402*b* may be less than the central peak 404 by as much as 40 dB, as a non-limiting example.

According to a further aspect of the present application, an antenna having one or more pivot points for adjusting a position of a feed horn is provided. Typically, it is desirable to control the location of a feed horn with great precision. In some scenarios, for example, it may be desirable for the feed horn to be positioned at the focal point of a reflector dish of the antenna. Even small deviations from the proper placement of the feed horn (e.g., deviations from the focal point of the reflector antenna) may substantially degrade performance of the antenna. Feed horns like that shown in FIG. 1 may be connected to the reflector dish via one or more feed arms (e.g., feed arms 106*a*-106*c*). Rigid connections between the feed horn and the feed arms may result in misplacement of the feed horn from a desired location due to misplacement of any one or more of the feed arms. By contrast, flexibility in connecting the feed horn and a feed arm may facilitate accurate placement of the feed horn.

As shown in FIG. 1, each of the feed arms 106*a*-106*c* may be coupled to the feed unit 104 via a respective pivoting connection 114*a*-114*c*. The pivoting connections may comprise a pivoting rod coupling the feed arms to the feed unit, or any other suitable pivoting component(s). In this manner, the feed unit may be able to pivot relative to the feed arms, which may allow for adjustment of the positioning of the feed unit in the event that the pivot arms are not completely accurately positioned. Thus, the feed unit may more easily be positioned at a desired location (e.g., a focal point of the reflector dish 102) than if the feed unit was rigidly connected to the feed arms.

Figure 5B:
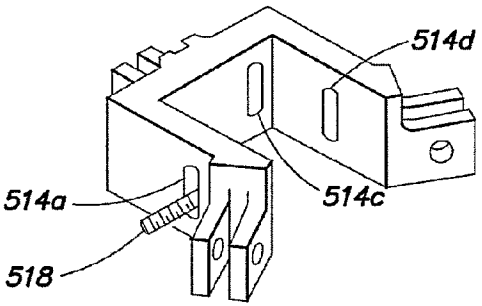
FIG. 5B illustrates an alternative view of the bracket of FIG. 5A.
Figure 5A:
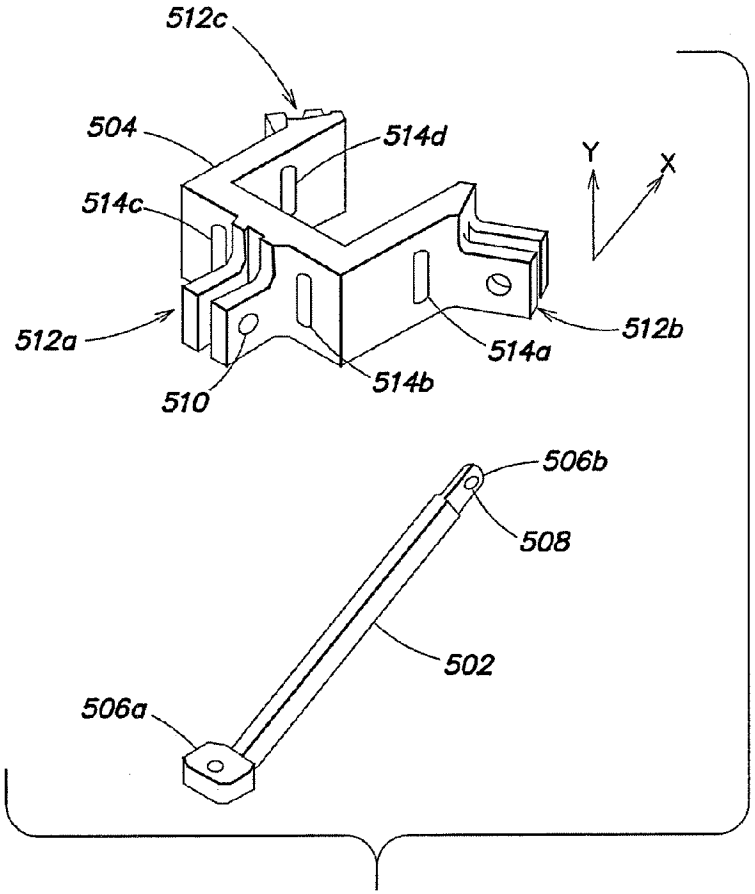
FIG. 5A illustrates a feed arm and bracket of an antenna, according to one non-limiting embodiment.

FIG. 5A illustrates a close-up view of a non-limiting example of a feed arm and mounting bracket, according to one embodiment. The feed arm 502 and mounting bracket 504 may be used as a feed arm and mounting bracket in the antenna 100 of FIG. 1. As shown, the feed arm 502 includes a first end 506*a* configured to mount to the antenna reflector dish and a second end 506*b* configured to pivotally couple to the bracket 504. For example, the end 506*b* may have an opening 508 formed therein, which may receive a screw, rod, or other suitable coupling member. The coupling member may also engage the hole 510 of bracket 504. In this manner, the bracket may be pivoted about the feed arm 502, offering flexibility in the positioning of the feed unit (not shown in FIG. 5A) coupled to the bracket, and thus offering the ability to accurately control positioning of the feed horn in the feed unit. As shown, the bracket 504 include three slotted receiving ends 512*a*-512*c*, which may each receive a respective feed arm. However, it should be appreciated that the various aspects described herein are not limited to using any particular number of feed arms, and that three arms is therefore a non-limiting example.

As shown in FIGS. 5A and 5B, which offer alternative views of the bracket 504, the bracket 504 may include one or more slots. In this non-limiting example, four slots 514*a*-514*d* are included. The bracket may accommodate a feed unit, such as feed unit 104 shown in FIG. 1. The feed unit may be secured to the bracket with screws, or other fastening mechanism 518, through the slots 514*a*-514*d*. Thus, the position of the feed unit may be adjusted within the bracket by movement of the fastening mechanism up or down within the slots, as a non-limiting example. In this manner, greater control and flexibility may be provided with respect to positioning of the feed unit, and therefore the feed horn. Suitable selection of the shape and size of the slots 514*a*-514*d* may allow for motion in the x and y-directions, as shown.

Figure 6A:
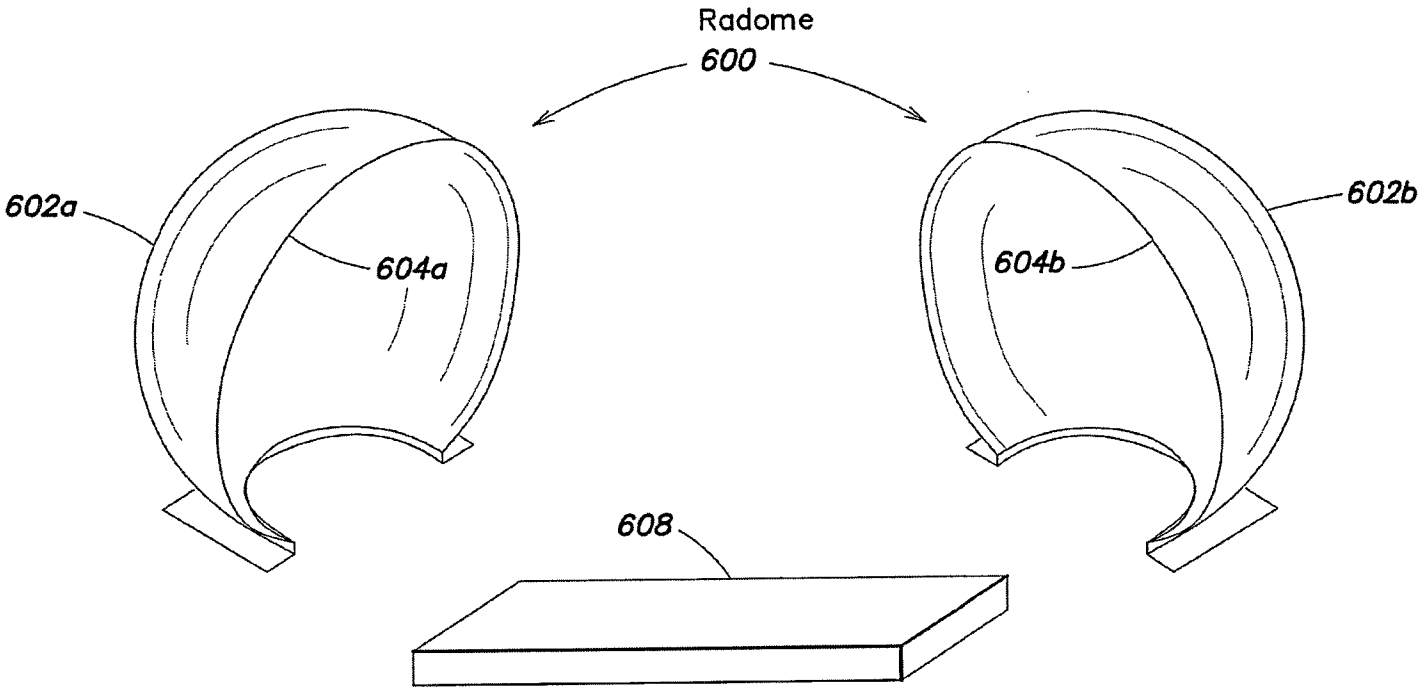
FIG. 6A illustrates a multi-piece radome, according to a non-limiting embodiment.

According to an aspect of the present application, a multi-piece radome is provided. FIG. 6A illustrates a non-limiting example, showing the radome in an open configuration. As shown, the radome 600 may include two pieces, 602*a* and 602*b*. The two pieces may be separable, as shown, to facilitate removal from the antenna (e.g., antenna 100 of FIG. 1) and placement around the antenna. In this manner, the antenna may more easily be accessed, for example to install the antenna, make adjustments/repairs, or for any other reason. Accordingly, it should be appreciated that the radome may be a removable radome, as contrasted to conventional fixed radomes.

In those embodiments in which a multi-piece radome is used, the radome may be formed of any suitable number of pieces and the pieces may be of any suitable shape and size. While FIG. 6 illustrates the non-limiting example of a 2-piece radome, other numbers of pieces may be used. Also, while the two pieces in FIG. 6 are shown as being substantially hemispherical, other shapes are possible. In some embodiments, the pieces 602*a* and 602*b* may be substantially the same as each other, though in other embodiments the two pieces may not be the same size and/or same shape.

The radome may be of any suitable size to accommodate the antenna (e.g., antenna 100). By making the radome of multiple pieces which may be coupled around an antenna, the size of the radome and therefore the volume occupied by the radome may be reduced, for example since the fully formed (coupled) radome need not be made large enough to fit over the antenna. According to one embodiment, the pieces may be sized to accommodate antenna scanning, e.g., ±30 degrees left-right and ±15 degrees up-down. Other ranges of motion are also possible.

The radome may be made of any suitable material. For example, the radome may be made of a material that is sufficiently transparent to electromagnetic radiation at the frequencies of operation of the antenna enclosed therein. For example, if the antenna is configured to operate at frequencies between approximately 30 GHz and approximately 38 GHz, then the radome may be made of material transparent (or substantially transparent) to such frequencies.

The pieces 602*a* and 602*b* may be couplable to each other in any suitable manner. For example, the pieces may fit together by friction or pressure fit, may be secured via glue (or other adhesive), may be coupled by screws, clips, or may be coupled in any other suitable manner. According to one non-limiting embodiment, a first piece of the two pieces may include a groove along one edge (e.g., along edge 604*a*) which may mate to the second piece (e.g., along edge 604*b*). Other manners for coupling the radome pieces together may be used.

Figure 6B:
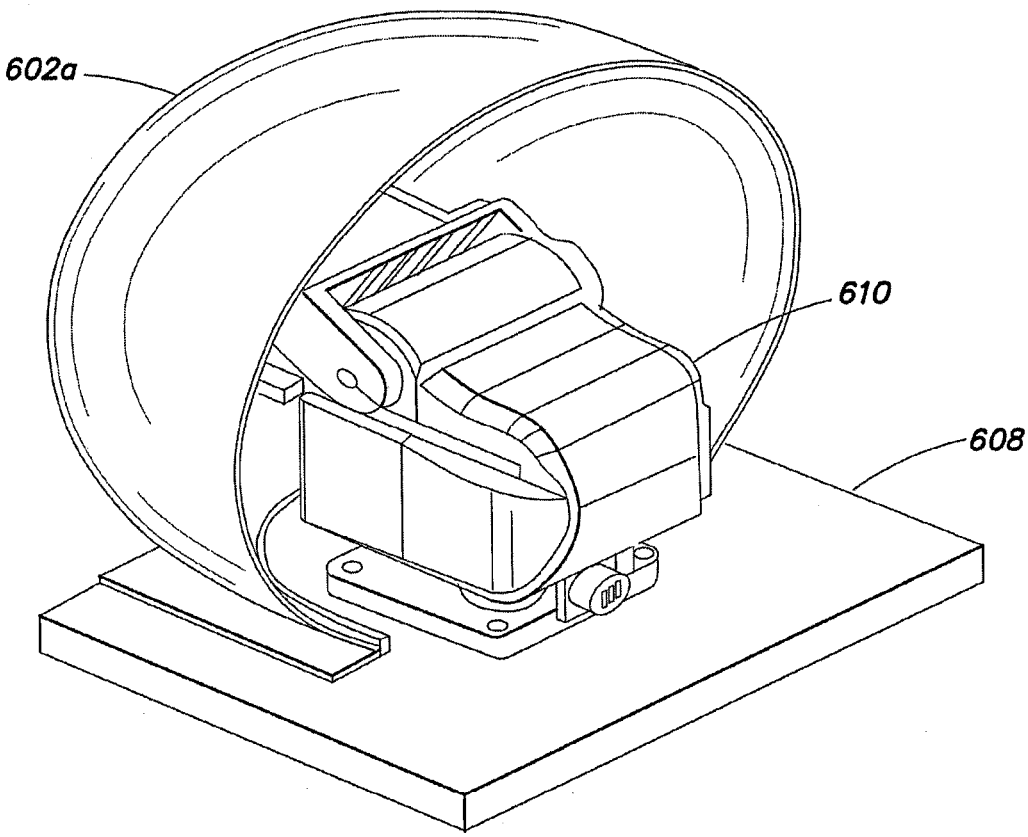
FIG. 6B illustrates an antenna in connection with part of the radome of FIG. 6A, according to a non-limiting embodiment.

The radome may be mounted to a plate 608 or other base in some embodiments. FIG. 6B offers an alternative view of this feature, illustrating an antenna 610 mounted to the plate 608 together with piece 602*a* of the radome 600. The plate may be any type of plate and the piece 602*a* and antenna 610 may be mounted to the plate in any suitable manner.

According to one or more of the foregoing aspects, various operating characteristics of an antenna may be achieved. For example, low power operation may be achieved (e.g., less than 5 W in some embodiments, which may be facilitated by use of a wide bandwidth (e.g., from 30-38 GHz)). As mentioned with respect to FIG. 4, low sidelobe behavior may also be achieved. Small objects (e.g., objects as small as ⅜ inch or smaller) may be detected. Low feed blocking and substantially constant beamwidth over a wide bandwidth (e.g., from 30-38 GHz) may also be achieved. Other operating characteristics are also possible. In addition, as mentioned, the antenna may be of relatively small size (e.g., six inches in diameter or smaller, in some embodiments).

Having thus described several aspects of at least one embodiment of the technology, it is to be appreciated that various alterations, modifications, and improvements will readily occur to those skilled in the art. Such alterations, modifications, and improvements are intended to be within the spirit and scope of the technology. Accordingly, the foregoing description and drawings provide non-limiting examples only.

In addition, while some references have been incorporated herein by reference, it should be appreciated that the present application controls to the extent the incorporated references are contrary to what is described herein.

What is claimed is:

1. A reflector antenna, comprising:

a feed unit comprising an offset corrugated horn having a first end, a second end, and a plurality of corrugations, wherein the first end has a wider opening than the second end; and a parabolic reflector dish coupled to the feed unit by a feed arm, wherein the reflector antenna is configured to exhibit a beam along a boresight direction of the reflector antenna having a substantially constant gain over a five degree beamwidth over a frequency range from 30 GHz to 38 GHz, and wherein the first end of the offset corrugated horn is positioned proximate to the parabolic reflector dish and a first corrugation of the plurality of corrugations closest to the first end of the offset corrugated horn is offset from the first end.

2. The reflector antenna of claim 1, wherein the reflector antenna has a f/D ratio of less than 0.4.

3. The reflector antenna of claim 2, wherein the f/D ratio is between 0.1 and 0.25.

4. The reflector antenna of claim 2, further comprising a feed cable configured to provide an electrical signal to the feed unit, wherein the feed arm comprises a groove configured to receive the feed cable.

5. The reflector antenna of claim 2, wherein the parabolic reflector dish has a diameter of less than seven inches.

6. The reflector antenna of claim 2, wherein the reflector antenna is configured as a scanning antenna.

7. An apparatus comprising:

a helicopter; and the reflector antenna of claim 2, wherein the reflector antenna is mounted on the helicopter.

8. The reflector antenna of claim 2, wherein the offset corrugated horn is configured to provide a variable location of a phase center of a signal therefrom.

9. The reflector antenna of claim 1, wherein the offset corrugated horn is a conical corrugated horn.

10. The reflector antenna of claim 9, further comprising a mounting bracket coupled to the feed arm and configured to receive the feed unit, wherein a position of the feed unit within the mounting bracket is adjustable.

11. The reflector antenna of claim 9, further comprising a multi-piece radome enclosing the parabolic reflector dish and the offset corrugated horn.

12. The reflector antenna of claim 11, wherein the multi-piece radome includes first and second pieces coupled to each other.

* * * * *